US010228220B2

(12) United States Patent
Berk

(10) Patent No.: US 10,228,220 B2
(45) **Date of Patent: *Mar. 12, 2019**

(54) THROWING GAME TARGET

(71) Applicant: Dustin Berk, Irvine, CA (US)

(72) Inventor: Dustin Berk, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/954,751

(22) Filed: Apr. 17, 2018

(65) Prior Publication Data

US 2019/0011230 A1 Jan. 10, 2019

Related U.S. Application Data

(63) Continuation of application No. 15/641,390, filed on Jul. 5, 2017, now Pat. No. 10,048,044.

(51) Int. Cl.
*F41J 3/00* (2006.01)
*A63B 67/06* (2006.01)

(52) U.S. Cl.
CPC ..... *F41J 3/0071* (2013.01); *A63B 67/06* (2013.01); *F41J 3/0047* (2013.01)

(58) Field of Classification Search
CPC ..... F41J 3/0047; A63F 9/0208; A63F 2009/0226; E01C 13/08; A63B 43/005
USPC ..... 273/348.4, 348.5; 473/193, 474, 171; 428/17
See application file for complete search history.

(56) References Cited

U.S. PATENT DOCUMENTS 1,075,264 A * 10/1913 Morrison, Jr. ..... 273/348.4
2,092,162 A * 9/1937 Hiatt ..... A63F 9/0208 273/348.5
2,099,908 A * 11/1937 Rosengarten ..... F41J 3/008 273/348
3,894,736 A * 7/1975 Foley ..... F41J 3/0047 473/574
3,949,989 A * 4/1976 Van Meter ..... F41J 3/0047 273/348
4,257,613 A * 3/1981 Meyer Thor Straten ..... F42B 6/003 473/574
4,356,220 A * 10/1982 Benedyk ..... A41G 1/009 428/17
4,824,120 A * 4/1989 Wang ..... F41J 1/00 273/348.5
5,531,450 A * 7/1996 Lu ..... F41J 3/0019 273/348
5,590,885 A * 1/1997 Graham ..... A63F 9/0208 273/338
5,613,686 A * 3/1997 Yiu ..... F41J 3/00 273/348.5
6,135,457 A * 10/2000 Yiu ..... F41J 3/0066 273/348.5
6,174,250 B1 * 1/2001 Hollis ..... A63B 43/005 473/573
6,708,976 B2 * 3/2004 Cho ..... F41J 3/0042 273/374

(Continued)

*Primary Examiner* — Mark Graham
(74) *Attorney, Agent, or Firm* — Jeffrey Sonnabend; SonnabendLaw

(57) ABSTRACT

A throwing game target having a back plate and multiple blades extending outwardly from the back plate. The blades may be comprised of horizontal and vertical blades. In such embodiments, the blades may be arranged in multiple groupings of three blades with at least one horizontal blade and one vertical blade.

10 Claims, 6 Drawing Sheets

(56) References Cited

U.S. PATENT DOCUMENTS

| | | | | |
|---|---|---|---|---|
| 2004/0026863 | A1* | 2/2004 | Cho | A63B 71/06 273/348.5 |
| 2013/0004683 | A1* | 1/2013 | Auguste | E01C 13/08 428/17 |
| 2016/0016075 | A1* | 1/2016 | Berk | A63F 9/0208 273/348.4 |

* cited by examiner

THROWING GAME TARGET

CROSS REFERENCE TO RELATED APPLICATIONS

This application is a continuation of co-pending application Ser. No. 15/641,390, incorporated herein in its entirety by reference.

BACKGROUND OF THE INVENTION

Field of the Invention

The invention relates generally to games and target games, and in particular, to specialized targets for certain non-piercing thrown projectiles such as throwing cards, soft-tipped darts and the like.

Description of the Related Art

Target games, and in particular, thrown projectile games, are well known. Principal among such games is the game of darts, in which sharp pointed miniature javlin-like projectiles called darts are thrown at a target, called a dartboard, hung on a vertical surface. Early dartboards were made of clay. Modern, high quality dartboards are made of sisal fibers, while less expensive boards are sometimes made of cork or coiled paper. Several types of sisal fiber are used in dartboards today, originating from East Africa, Brazil, or China.

More recently, a variation of the game of darts has emerged in which the darts have soft, flexible, non-metallic tips instead of sharpened, piercing metal tips. In such embodiments, the target dartboards may be made of plastic facings with small holes. The holes may slant out, allowing the plastic-tipped darts to stick inside.

Both sharpened tipped darts and soft-tip darts are pointed so as to be received by a traditional dartboard (in the case of sharpened tipped darts) or by a perforated soft-tip dartboard (in the case of soft-tip darts). Neither traditional dartboards nor soft-tip dart boards are readily capable of receiving any thrown object in ordinary use and/or without damaging or destroying the target board. It is therefore desirable to have a throwing game target that can receive non-pointed projectiles in ordinary use and without damage or destruction.

SUMMARY OF THE INVENTION

Embodiments of the present invention include a throwing game target having a panel having a back plate and multiple blades extending outwardly from the back plate. The blades may be comprised of horizontal and vertical blades. In such embodiments, the blades may be arranged in multiple groupings of three blades with at least one horizontal blade and one vertical blade.

The foregoing embodiments may have blades with a straight side portion and two opposing rounded end portions, each rounded end portion having an arc and having a tip, and each of the blades having a center point and an arc center for each of the rounded end portions.

Additionally, the foregoing embodiments may have: the vertical blades positioned so that a line formed by the center points and the arc centers runs through a center of an adjacent horizontal blade; and/or pairs of adjacent horizontal blades that are positioned such that a tip of first horizontal blade is aligned vertically with the a tip of a second horizontal blade; and/or blades arranged so that the arc centers of a first vertical blade align horizontally with a center point of a space between adjoining blade pairs.

In any of the foregoing embodiments, the blades may have a proximal end adjacent to the back plate and a distal end opposite the proximal end. Each of the proximal ends and distal ends have a length parallel to the back plate, and the length of the proximal end may be longer than the length of the distal end.

The foregoing Summary of the Invention is not intended to limit the scope of the disclosure contained herein nor limit the scope of the appended claims. To the contrary, as will be appreciated by those persons skilled in the art, variations of the foregoing described embodiments may be implemented without departing from the claimed invention.

BRIEF DESCRIPTION OF THE DRAWINGS

The objects and features of the invention may be understood with reference to the following detailed description of an illustrative embodiment of the present invention taken together in conjunction with the accompanying drawings in which.

DESCRIPTION OF THE PREFERRED EMBODIMENT

Figure 1:
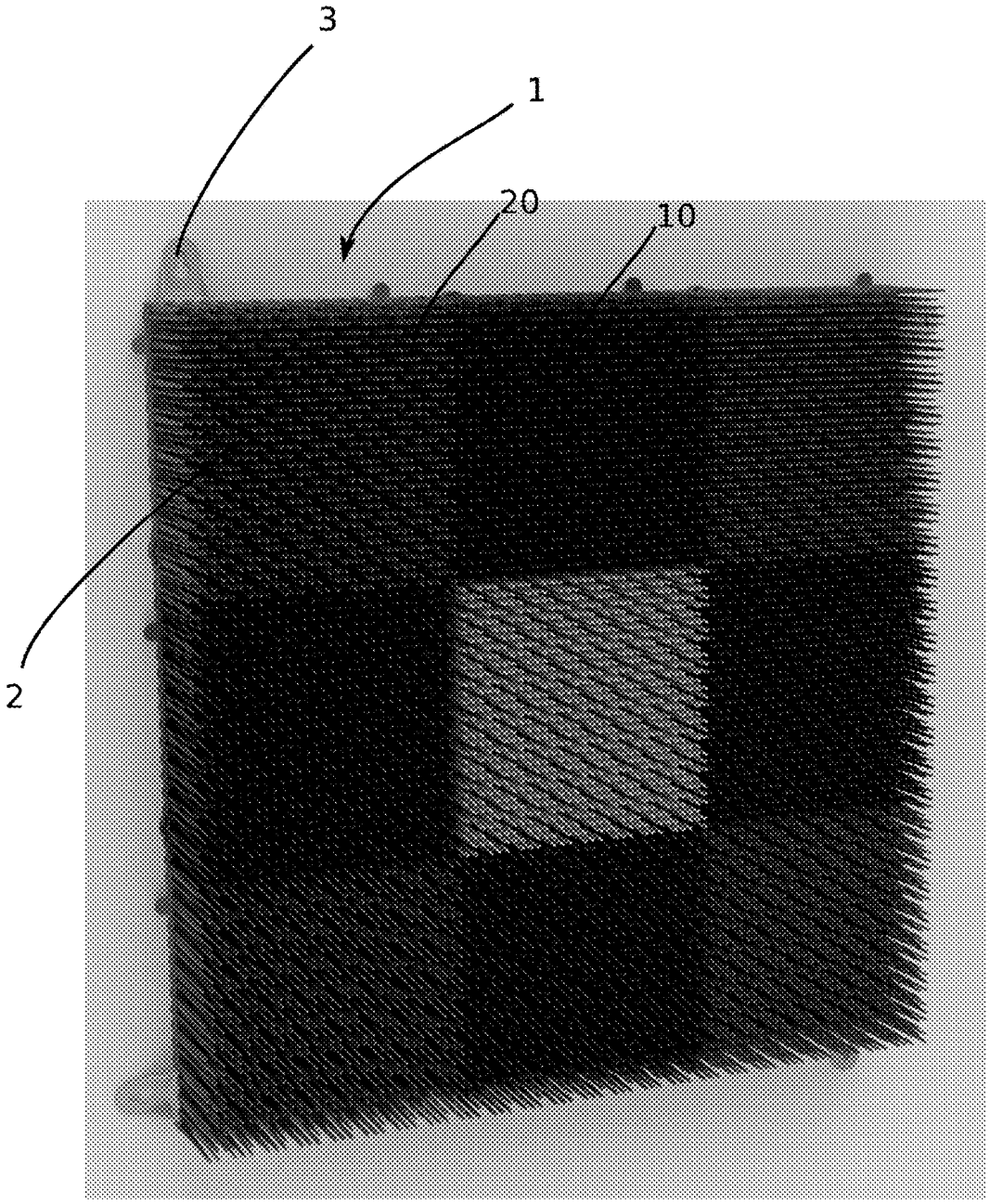
FIG. 1 is an orthogonal view of a preferred embodiment of the instant invention.

Referring first to FIG. 1, there is shown a throwing game target in accordance with a preferred embodiment of the instant invention. Target 1 is comprised of multiple panels 2, each of which may be substantially identical and may be shaded, colored or decorated so as to differentiate it from one or more of the other panels. The separate panels 2 may be connected to one another as described in more detail in connection with FIG. 2. Each panel is comprised of a back plate 10 on which an array of blades 20 is formed. Interstitial spaces 29 are formed between blades 20. Mounting clips 3 may be utilized to attach target 1 to a vertical surface such as a wall using, for example, screws or other well known fasteners.

Figure 2:
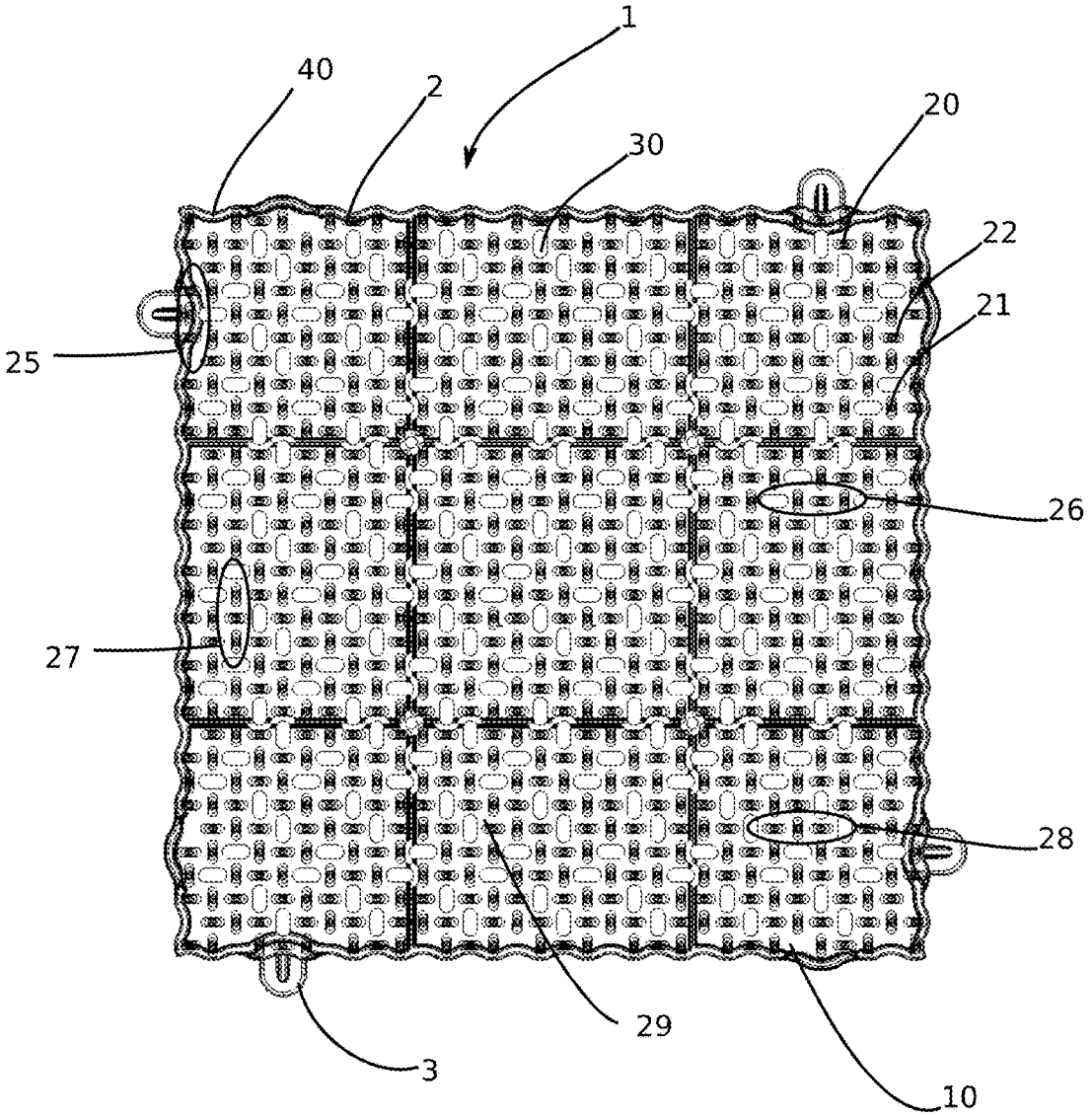
FIG. 2 is a top plan view of the preferred embodiment of the instant invention depicted in FIG. 1.

Referring now to FIG. 2, there is shown a top plan view of the preferred embodiment of FIG. 1. Target 1 is comprised of multiple panels 2. Each panel 2 includes thereon numerous blades 20 in a defined pattern such that spaces 29 are formed between the several blades 20. Each blade is either a horizontal blade (i.e., in a horizontal orientation), 22, or a vertical blade (i.e., in a vertical orientation), 21. The blades 20 are formed in four different but overlapping groupings, 25 through 28. Grouping 25 is a vertical grouping comprised of two horizontal and one vertical blades. Grouping 26 is a horizontal grouping comprised of two vertical and one horizontal blades. Grouping 27 is a vertical grouping comprised of two vertical and one horizontal blades. Grouping 28 is a horizontal grouping comprised of two horizontal and one vertical blades. Horizontal and vertical groupings are defined by the orientation of a line drawn substantially through the centers of the blades, as will be readily understood.

It will be understood that as discussed herein, blades 20 may be "placed on" panels 2 by any attachment means or by being molded with panels 2, and "placed on" should not be understood to be limited to embodiments in which blades 20 are formed separately from panels 2 and thereafter affixed thereto, such embodiments contemplated in addition to integrally formed blade/panel components.

Sidewall 40 is shown with an undulating configuration such that the indents and outdents (i.e., raised and lowered portions of the "wave") mate with opposite portions of other panels, thereby allowing them to interconnect, as will be described in greater detail below.

Also depicted in FIG. 2, holes 30 may be formed in back plate 10 to permit additional securing means for attachment to vertical surfaces, or to permit the attachment of accessories such as electronic scoring devices, lights, etc.

Figure 3:
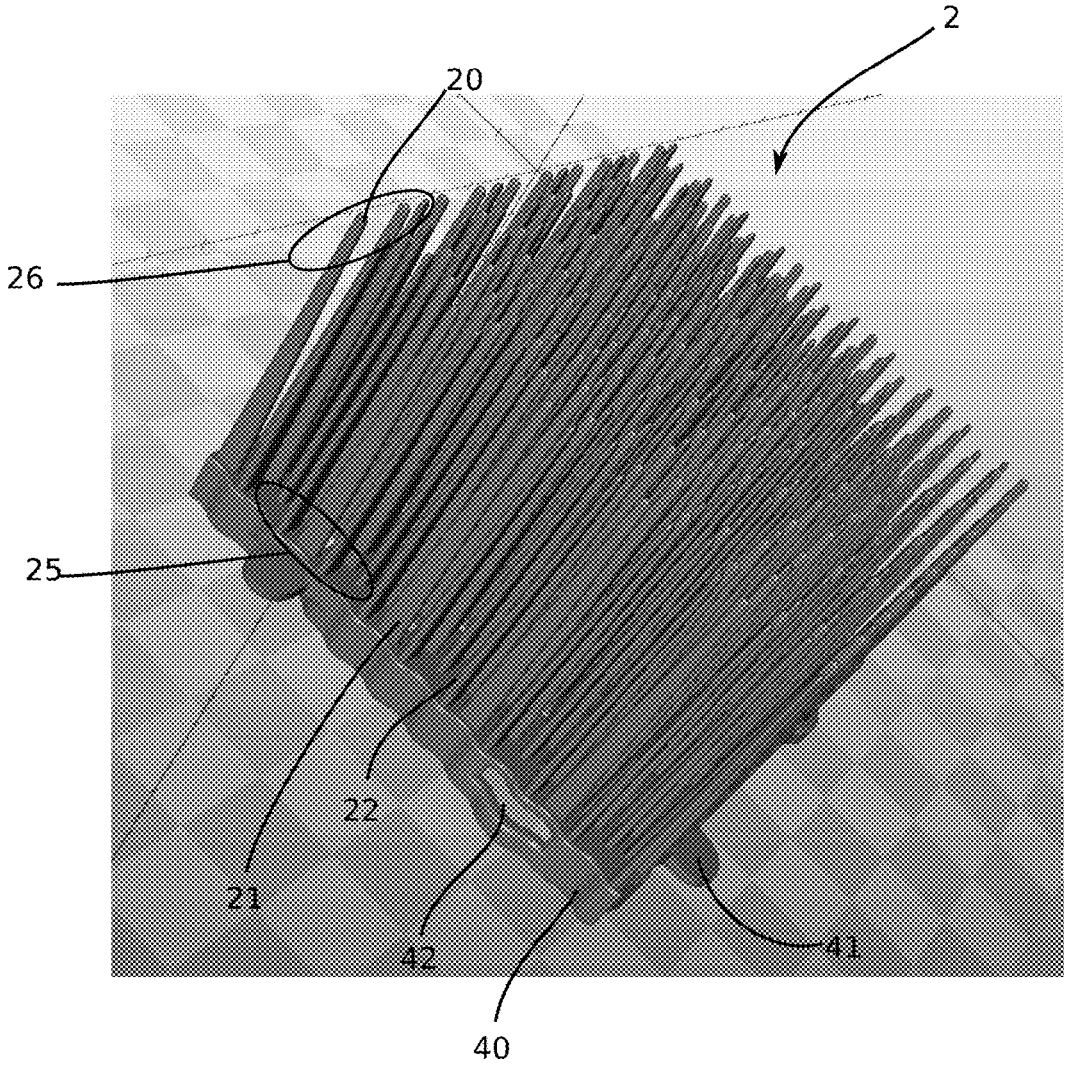
FIG. 3 is an orthogonal view of a panel of a preferred embodiment of the instant invention.

Referring to FIG. 3, there is shown a plate 2 having multiple blades 20 in both vertical orientation 21 and horizontal orientation 22. Also shown are vertical groupings of blades comprised of two horizontal and one vertical blades 25, and horizontal grouping of blades comprised of two vertical and one horizontal blades 26.

Tabs 41 and slots 42 are formed in sidewall 40 such that when two plates are interconnected, the slot 42 of one plate is configured to receive tab 41 of the other plate, thereby improving the interconnection of the plates and the rigidity of the resulting structure. Tabs 41 may be shaped so that they lock into slots 42 and may also be elastically deformable to facilitate connectivity, as is well known. Alternatively, for plates on the periphery of a multiple-plate structure (i.e., one created by interconnecting multiple plates), slot 42 may accept a mounting clip, depicted in FIGS. 2 and 6, for example, and connectable to slot 42 in the same manner as tabs 41.

As can be seen in FIG. 3, the blades of a preferred embodiment of the present invention are generally triangular in shape such that the base of each blade is wider than the tip. The tip of each blade may be rounded as well. This blade shape allows for improved receiving and capture of projectiles.

Figure 4:
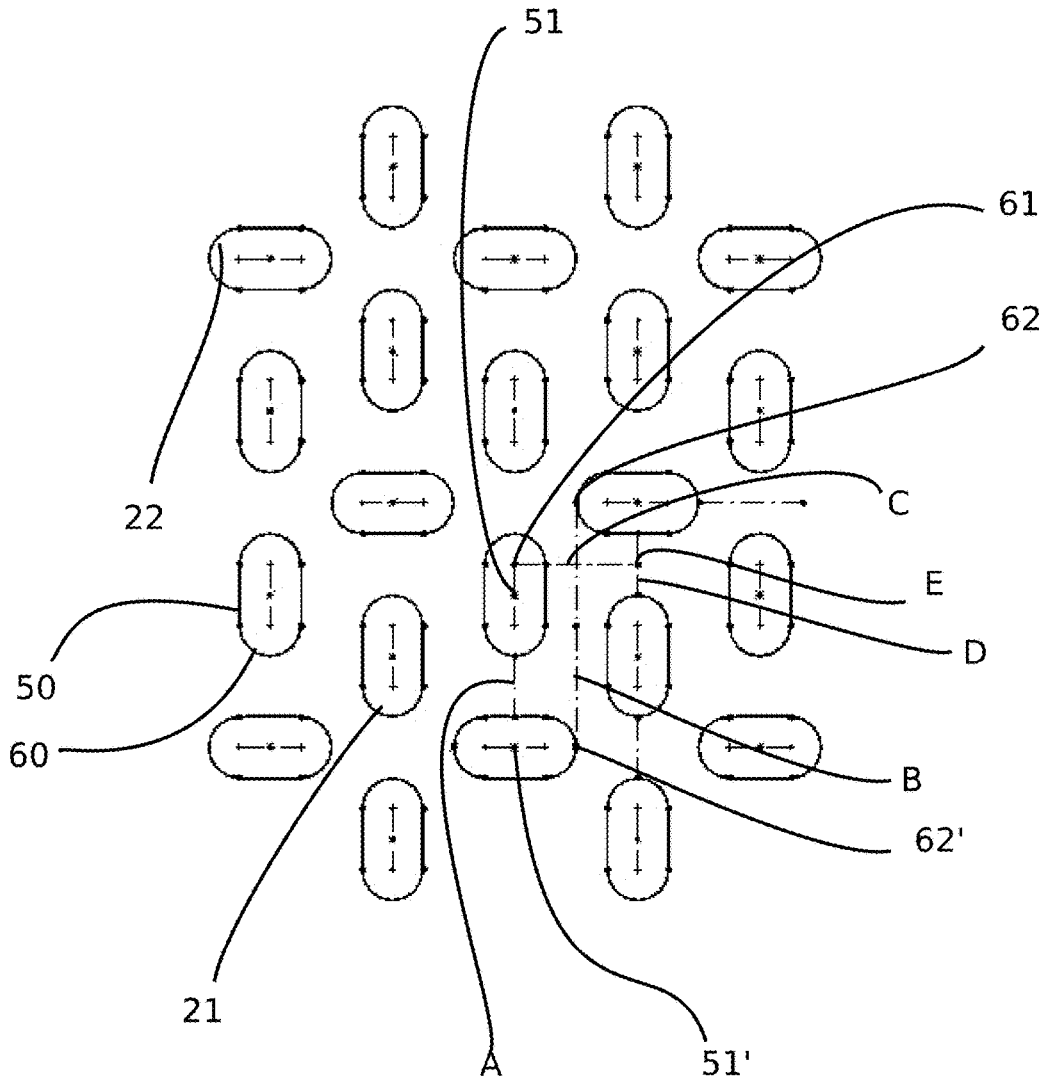
FIG. 4 is a plan view of an arrangement of blades of a preferred embodiment of the instant invention.

FIG. 4 shows a plan view of an arrangement of blades in a preferred embodiment of the present invention. As will be immediately apparent, the configuration shown in FIG. 4 is similar but not identical to that depicted in FIGS. 1 through 3; however, the configuration in FIG. 4 lacks holes 30. The blade arrangement is shown with reference to the base of each blade, with both vertical blades 21 and horizontal blades 22 depicted.

Each blade has a straight side portion 50 and two opposing rounded end portions 60, each comprising an arc. Each blade has a single center point 51 and one arc center 61 for each rounded end portion. Each rounded end portion 60 has a tip 62 positioned along the line formed by center point 51 and the two arc centers 61. The tip need not be pointed or otherwise structurally distinct from any other portion of the rounded end portion 60, the tip instead being defined by a point located as described herein. The pattern depicted in FIG. 4 is such that vertical blades 21 are positioned so that the line formed by center point 51 and the two arc centers 61 runs through the center 51' of adjacent or nearby horizontal blades 22, as shown by line A in the figure. Also, pairs of adjacent or nearby horizontal blades 22 are positioned such that the left side tip 62 of one horizontal blade 22 is aligned vertically with the right side tip 62' of the other horizontal blade 22, as shown by line B in the figure. Furthermore, the blades are arranged so that one of the two arc centers 62 of each vertical blade 21 aligns horizontally with the center point of the space between adjoining or nearby blade pairs, as shown by lines C and D and point E in the figure.

Figure 5:
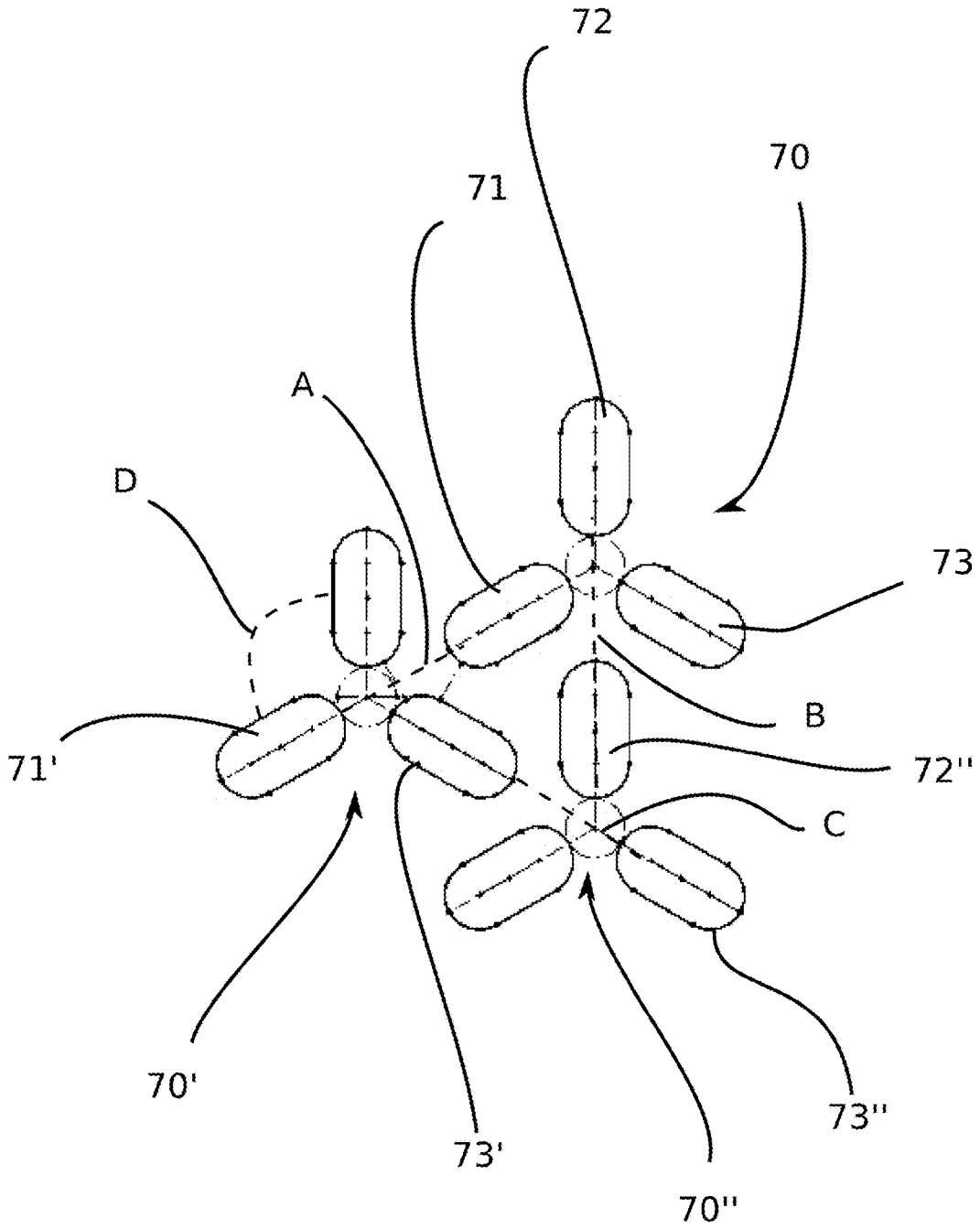
FIG. 5 is a plan view of an alternative arrangement of blades of a preferred embodiment of the instant invention.

Shown in FIG. 5 is a blade arrangement of a different preferred embodiment. In this preferred embodiment, blade groupings 72 are radial. Each grouping 72 includes three blades, a vertical blade 72, a left blade 71 and a right blade 73. The groupings are arranged such that the center line of left blade 71 of a first grouping 70 is collinear with the center line of a left blade 71' of an adjacent or nearby grouping 70', as shown by line A in the figure. The center line of vertical blade 72 of a first grouping 70 is collinear with the center line of a vertical blade 72" of an adjacent or nearby grouping 70", as shown by line B in the figure. The center line of right blade 73' of a first grouping 70' is collinear with the center line of a right blade 73" of an adjacent or nearby grouping 73", as shown by line C in the figure. The blades of each grouping may be space apart at 120°, as shown by angle D in the figure.

Figure 6:
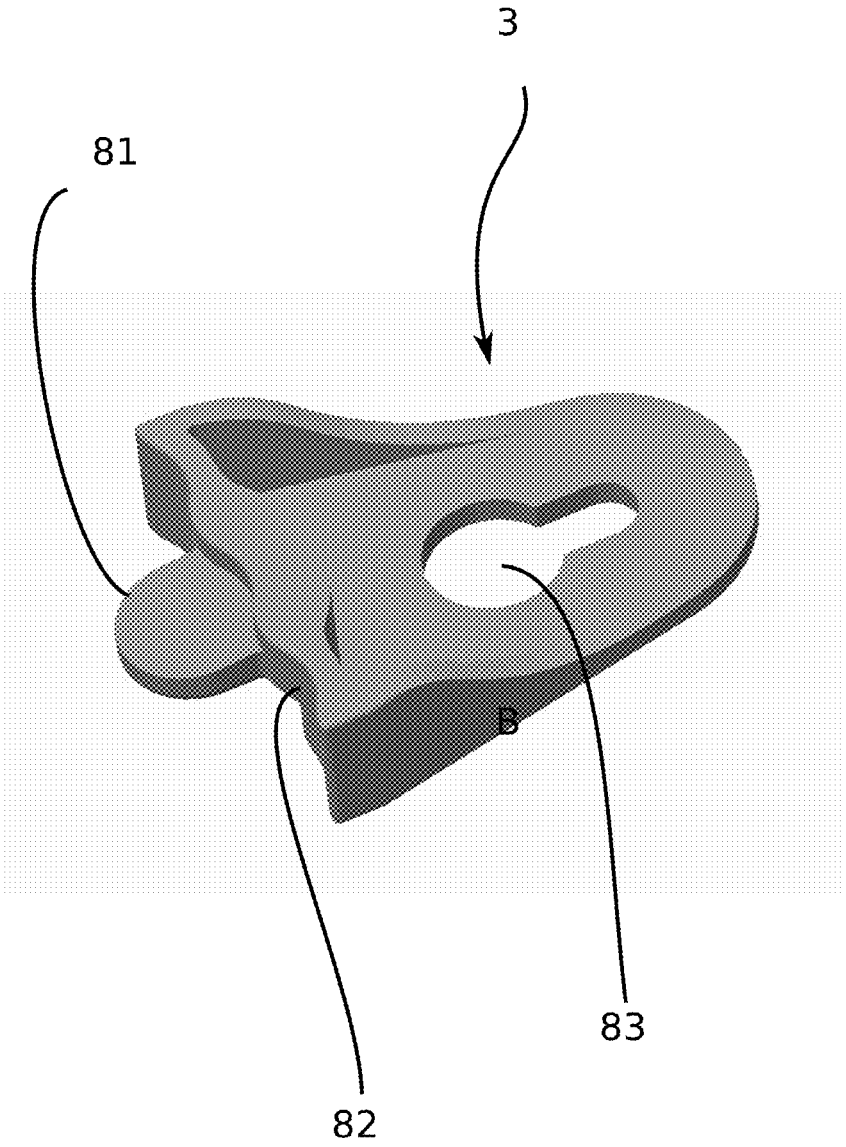
FIG. 6 is an orthogonal view of a mounting clip of a preferred embodiment of the instant invention.

FIG. 6 depicts a mounting clip 3 in accordance with a preferred embodiment of the present invention. Mounting clip 3 includes tab 81 which is configured to mate with slot 42 shown for example in FIG. 3. Sidewall 82 of mounting clip 3 is configured with an undulating configuration such that the indents and outdents (i.e., raised and lowered portions of the "wave") mate with corresponding portions of panels 2 as shown for example in FIG. 3 in a similar fashion to panel-to-panel mating as described above. Aperture 83 is configured to receive securely a fastening means such as a screw or the like, as previously described.

Although the particular embodiments shown and described above will prove to be useful in many applications in the art to which the present invention pertains, further modifications of the present invention will occur to persons skilled in the art. All such modifications are deemed to be within the scope and spirit of the present invention as defined by the appended claims.

What is claimed is:

1. A throwing game target comprising:

a back plate;

multiple blades extending outwardly from said back plate, the blades comprising horizontal and vertical blades;

wherein said blades are arranged in multiple groupings of three blades with at least one horizontal blade and one vertical blade, and wherein each of said blades has a proximal end at said back plate, a distal end opposite said proximal end, and a space formed between each adjacent pair of blades, said space extending from said distal end to said proximal end and terminating at said back plate, said space comprising an unobstructed void between each of said adjacent pairs of blades from said distal end to said back plate.

2. The throwing game target of claim 1, wherein:

each of said blades has a straight side portion and two opposing rounded end portions, each rounded end portion comprising an arc and having a tip; and each of said blades has a center point and an arc center for each of said rounded end portions.

3. The throwing game target of claim 2, wherein said vertical blades are positioned so that a line formed by said center points and said arc centers runs through a center of an adjacent horizontal blade.

4. The throwing game target of claim 3 wherein said blades have a proximal end adjacent to said back plate and a distal end opposite said proximal end, each of said proximal end and said distal end having a length parallel to said back plate, wherein said length of said proximal end is longer than said length of said distal end.

5. The throwing game target of claim 2, wherein pairs of adjacent horizontal blades are positioned such that a tip of a first horizontal blade is aligned vertically with the a tip of a second horizontal blade.

6. The throwing game target of claim 5 wherein said blades have a proximal end adjacent to said back plate and a distal end opposite said proximal end, each of said proximal end and said distal end having a length parallel to said back plate, wherein said length of said proximal end is longer than said length of said distal end.

7. The throwing game target of claim 2, wherein said blades are arranged so that an arc centers of a first vertical blade align horizontally with a center point of a space between adjoining blade pairs.

8. The throwing game target of claim 7 wherein said blades have a proximal end adjacent to said back plate and a distal end opposite said proximal end, each of said proximal end and said distal end having a length parallel to said back plate, wherein said length of said proximal end is longer than said length of said distal end.

9. The throwing game target of claim 2, wherein:

said vertical blades are positioned so that a line formed by said center points and said arc centers runs through a center of an adjacent horizontal blade;

pairs of adjacent horizontal blades are positioned such that a tip of a first horizontal blade is aligned vertically with the a tip of a second horizontal blade; and said blades are arranged so that the arc centers of a first vertical blade align horizontally with a center point of a space between adjoining blade pairs.

10. The throwing game target of claim 9 wherein said blades have a proximal end adjacent to said back plate and a distal end opposite said proximal end, each of said proximal end and said distal end having a length parallel to said back plate, wherein said length of said proximal end is longer than said length of said distal end.

* * * * *